United States Patent [19]

Fenzl

[11] Patent Number: 4,781,131

[45] Date of Patent: Nov. 1, 1988

[54] SEWING MACHINE HAVING A SEWING-MATERIAL CUTTING DEVICE

[75] Inventor: Horst Fenzl, Oerlinghausen, Fed. Rep. of Germany

[73] Assignee: Durkoppwerke GmbH, Fed. Rep. of Germany

[21] Appl. No.: 16,210

[22] Filed: Feb. 19, 1987

[30] Foreign Application Priority Data

Jun. 28, 1986 [DE] Fed. Rep. of Germany ..... 3621785

[51] Int. Cl.[4] ..... D05B 37/04

[52] U.S. Cl. ..... 112/130

[58] Field of Search ..... 112/122, 125, 129, 130; 66/147

[56] References Cited

U.S. PATENT DOCUMENTS 907,619 12/1908 Merrow ..... 112/129
907,620 12/1908 Merrow ..... 112/129
907,622 12/1908 Merrow ..... 112/129
1,947,495 2/1934 Routtenberg ..... 112/129
3,369,509 2/1968 Burton ..... 112/129

FOREIGN PATENT DOCUMENTS 6604108 12/1963 Fed. Rep. of Germany .
1889277 3/1984 Fed. Rep. of Germany .
645294 9/1962 Italy ..... 112/125

*Primary Examiner*—H. Hampton Hunter
*Attorney, Agent, or Firm*—Ostrolenk, Faber, Gerb & Soffen

[57] ABSTRACT

A sewing-material cutting device includes a movable upper knife and a stationary bottom knife which cooperates therewith. The upper knife includes a knife holder which holds a replaceable turnable cutting plate having a plurality of cutting edges. A polygonal fastener is provided on the cutting plate for selectively engaging the knife holder in a plurality of positions corresponding to respective cutting positions of the plurality of cutting edges.

11 Claims, 2 Drawing Sheets

SEWING MACHINE HAVING A SEWING-MATERIAL CUTTING DEVICE

BACKGROUND OF THE INVENTION

The present invention relates to a sewing machine which includes a sewing-machine cutting device comprising a movable upper knife and a stationary bottom knife which cooperates therewith.

The prior art includes a number of sewing-material cutting devices of the general type mentioned above, in which a movable upper knife cooperates with a fixed bottom knife for cutting sewing material. All the known solutions have the feature in common that they have an upper knife of relatively complicated form; see, e.g., Federal Republic of Germany Utility Model 66 04 108, especially FIG. 21.

There is also known an upper knife having a carbide metal tip for edge trimming devices on sewing machines, see Federal Republic of Germany Utility Model 18 89 277, this knife also having a complicated structure.

As a result of these complicated prior art designs, the upper knives known up to the present time have all had the disadvantage of being expensive parts which are subject to wear. Accordingly, it has been the practice for decades to sharpen by regrinding dulled cutting edges which are no longer suitable for use. The regrinding requires a special knife-grinding apparatus which must be equipped with cutting stands for all or most of the different possible cutting angles. Since the regrinding must be carried out by skilled personnel, it is wage-intensive. Another disadvantage is that the reground upper knife must also be installed and adjusted for proper cutting by skilled personnel, in view of the displacement of the cutting edge which takes place by virtue of the regrinding.

SUMMARY OF THE INVENTION

Therefore, a primary object of the present invention is to provide an upper knife for a sewing-material cutting device which can be manufactured at low cost, has a longer life than the previously known upper knives, and can be replaced by the operator with a few turns of the hand.

In accordance with a broad aspect of the invention, this object is achieved by a sewing machine which includes a sewing-material cutting device, comprising a movable upper knife and a stationary bottom knife which cooperates therewith, wherein the upper knife includes a knife holder which holds a replaceable turnable cutting plate having a plurality of cutting edges.

With the upper knife of the invention, it is now possible, by using a turnable cutting plate having four cutting edges, for example, to obtain four times longer life than with a conventional upper knife. Furthermore, constant good cutting accuracy is assured since subsequent adjustment of the cutting edge after turning or replacing a turnable cutting plate is not necessary. Due to the relatively low price of the turnable cutting plate of the invention, subsequent regrinding is no longer worthwhile.

According to a further advantageous aspect of the invention, the turnable cutting plate is connected to the knife holder by an additional fastening element.

Preferably, the turnable cutting plate is provided with a polygonal protruding shaft, which permits the elimination of a stop edge on the knife holder for aligning the turnable cutting plate with the knife holder.

BRIEF DESCRIPTION OF THE DRAWINGS

Other objects, features and advantages of the invention will be seen from the following detailed description of two embodiments thereof, in which.

DETAILED DESCRIPTION OF PREFERRED EMBODIMENTS

Figure 6:
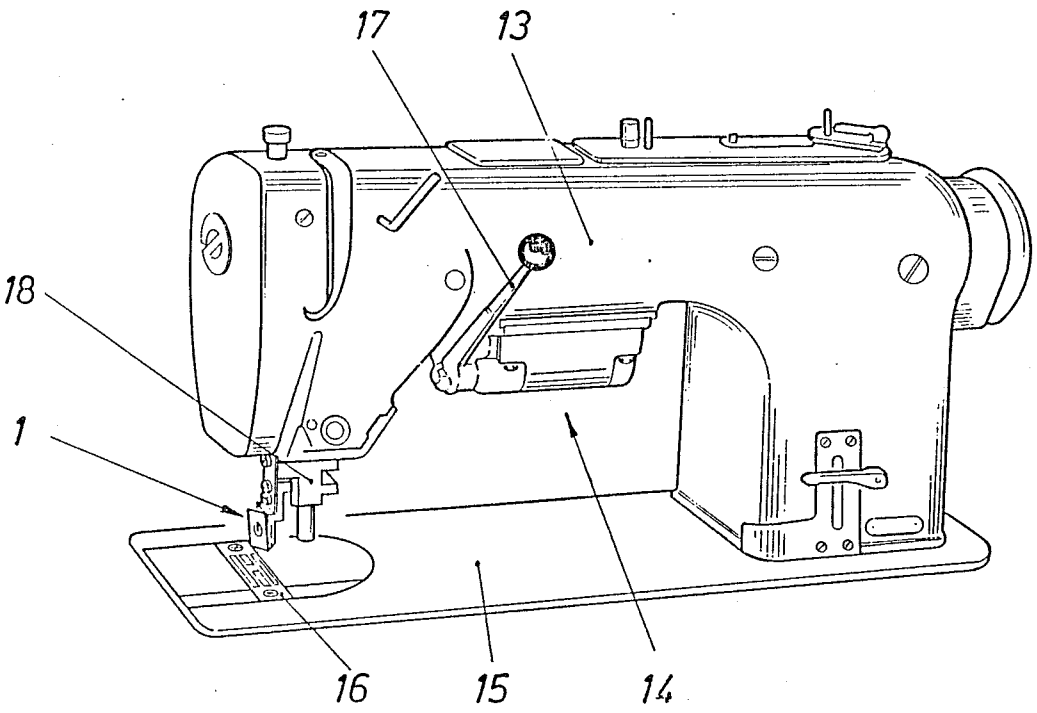
FIG. 6 is a perspective view of a conventional sewing machine having a sewing-material cutting device according to an embodiment of the invention mounted thereon.

FIG. 6 shows a conventional sewing machine 13 which has been provided with a sewing-material cutting device 14 according to an embodiment of the invention, the machine being made suitable thereby for the sewing and simultaneous cutting of the sewing material. Various known components, such as the needle bar, sewing needle, presser rod, and sewing foot have not been shown.

The cutting device 14 comprises a block 18 which can be moved up and down, and on which an upper knife 1 is mounted. The upper knife cooperates with a fixed bottom knife 20 for cutting sewing material, the bottom knife 20 being fastened preferably to the bottom of a foundation plate 15 and the cutting edge thereof being arranged preferably within a throat plate 16. Alternatively, the bottom knife 20 can also be mounted directly on the throat plate 16.

The cutting device 14 has a shift lever 17 for driving the driven upper knife 1 in up-and-down movement. The upper knife 1 includes two parts, a knife holder 2 which is fastened to the block 18, and a turnable cutting plate 3 mounted on the knife holder 2.

FIGS. 1–4 show a first embodiment of the invention, in which the turnable cutting plate 3 is mounted on the knife holder 2 by means of a screw 7 which is countersunk into the plate 3. In this embodiment, the cutting plate 3 has four cutting edges 4, which are preferably at an equal distance from an axis of symmetry 6. Each cutting edge 4 forms, with a front side 5 of the cutting plate 3, a cutting angle which is designed to be favorable for cutting.

Figure 1:
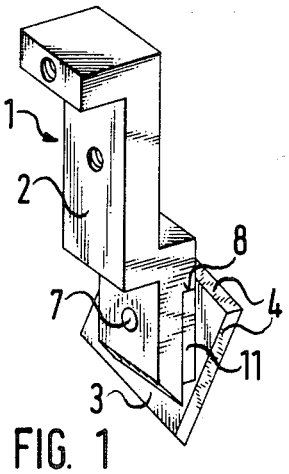
FIG. 1 is a perspective view of a complete assembly including an upper knife and an associated knife holder.
Figure 2:
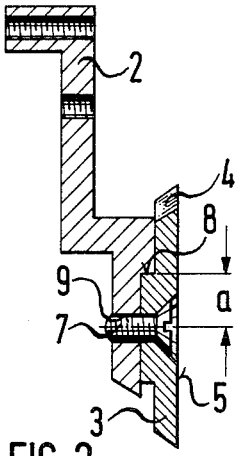
FIG. 2 is a cross-sectional view corresponding to FIG. 1.
Figure 3:
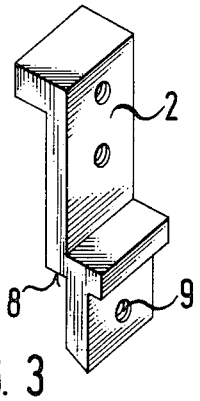
FIG. 3 is a perspective view of the knife holder of FIG. 1.
Figure 4:
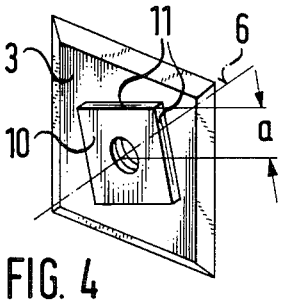
FIG. 4 is a perspective view of a turnable cutting plate having a polygonal mounting extension.

On the side of the turnable cutting plate 3 which is opposite the front side 5, there is provided a polygonal mounting extension 10 (best seen in FIG. 4) which has as many resting edges 11 as the turnable cutting plate 3 has cutting edges 4. Since it is advantageous in many cases of use for the cutting edge 4 to form an angle with the horizontal, it is advisable to arrange the mounting extension 10, as shown in FIG. 4, in such a manner that each resting edge 11 forms a well-defined angle with the cutting edge 4 which faces it. As seen in FIG. 4, each resting edge 11 is at a distance a from the axis of symmetry 6.

The knife holder 2 has a threaded hole 9 to receive the countersunk screw 7, as well as a stop edge 8 which also is spaced the above-mentioned distance a from the center line of the threaded hole 9. The cutting plate 3 is secured to the knife holder by the screw 7 with a given resting edge 11 engaging the stop edge 8 of the knife holder 2, thus exposing for use the one of the cutting edges 4 which corresponds to the given resting edge 11.

Then, by loosening the countersunk screw 7, a different cutting edge 4 which is still sharp can, by suitable rotation of the turnable cutting plate 3, be brought into the position contemplated for dependable cutting by the upper knife 1. After the turnable cutting plate 3 is rotated, it is again fastened by tightening the countersunk screw 7. Since all cutting edges 4 of a given turnable cutting plate 3 are at the same distance from the axis of symmetry 6, no subsequent adjustment of the upper knife 1 is necessary. In this way, assurance is had that the operator can easily effect personally the replacement or rotation of a turnable cutting plate 3, in the same way as the replacement of a broken needle.

Figure 5:
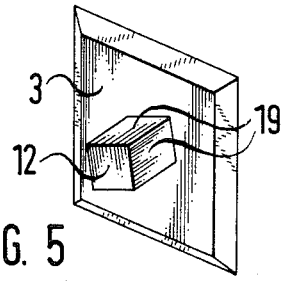
FIG. 5 is a perspective view of a turnable cutting plate having a polygonal shaft.

In another embodiment of the upper knife of the invention, shown in FIG. 5, the turnable cutting plate 3 has a protruding polygonal shaft 12. The shaft 12 is arranged at the axis of symmetry 6 of said cutting plate and can be introduced into an opening (not shown) in the knife holder, the opening having a shape corresponding to the cross-section of the shaft 12. The opening in the knife holder acts on the surfaces 19 to secure the cutting plate 3 in rotational position.

By means of the shaft 12, the turnable cutting plate 1 of FIG. 5 may be mounted on the knife holder in various alternative ways, such as in force-locked or form-locked manner, or by conventional holding or clamping means.

In order to permit economical manufacture of the turnable cutting plate 3, it is advisable that it be made as a precision casting of so-called knife steel, or as a sintered carbide part, for example. Both methods of manufacture result in finished parts which require no additional work except for the sharpening of the cutting edges 4. Alternatively, the turnable cutting plate 3 can also be made of compressed ceramic material.

Although illustrative embodiments of the invention have been described herein, it is to be understood that the invention is not limited to such embodiments, but rather that various modifications thereof may occur to one skilled in this art, still within the scope of the present invention.

What is claimed is:

1. A sewing machine having a sewing-material cutting device, the cutting device comprising:

(a) a movable upper knife, the upper knife including a knife holder and a replaceable turnable cutting plate having a plurality of cutting edges;

(b) a stationary bottom knife cooperating with the upper knife to cut sewing material; and (c) fastening means disposed substantially at an axis of symmetry of said cutting plate for replaceably and turnably fastening the turnable cutting plate to the knife holder with a selected one of said cutting edges in a cutting position;

wherein the fastening means comprises a polygonal member having a plurality of side surfaces, each of the side surfaces corresponding to a respective one of said plurality of cutting edges of said cutting plate, and each of said side surfaces selectively engaging a portion of said knife holder for maintaining the corresponding cutting edge in said cutting position.

2. A sewing machine having a sewing-material cutting device, the cutting device comprising:

(a) a movable upper knife, the upper knife including a knife holder and a replaceable turnable cutting plate having a plurality of cutting edges;

(b) a stationary bottom knife cooperating with the upper knife to cut sewing material; and (c) fastening means disposed substantially at an axis of symmetry of said cutting plate for replaceably and turnably fastening the turnable cutting plate to the knife holder with a selected one of said cutting edges in a cutting position;

wherein the fastening means comprises a screw disposed substantially at said axis of symmetry of said cutting plate;

the knife holder has a stop edge and a threaded hole at a predetermined distance from said stop edge; and the cutting plate has on a side thereof toward said knife holder a polygonal mounting attachment which has a plurality of resting edges for selectively engaging said stop edge, said resting edges being disposed at said predetermined distance from said axis of symmetry, each of said resting edges corresponding to a respective one of the cutting edges.

3. A sewing machine according to claim 2, wherein the screw is countersunk into the cutting plate.

4. A sewing machine having a sewing-material cutting device, the cutting device comprising:

(a) a movable upper knife, the upper knife including a knife holder and a replaceable turnable cutting plate having a plurality of cutting edges;

(b) a stationary bottom knife cooperating with the upper knife to cut sewing material; and (c) fastening means disposed substantially at an axis of symmetry of said cutting plate for replaceably and turnably fastening the turnable cutting plate to the knife holder with a selected one of said cutting edges in a cutting position;

wherein the fastening means comprises a polygonal shaft having a plurality of side surfaces, each corresponding to a respective one of the cutting edges, said shaft protruding from the turnable cutting plate for selective mounting on the knife holder in a plurality of rotational positions, each said position corresponding to a respective one of said plurality of side surfaces.

5. A sewing machine according to claim 1, wherein said cutting plate comprises compressed ceramic material.

6. A sewing machine according to claim 1, wherein the cutting plate comprises knife steel.

7. A sewing machine according to claim 1, wherein said cutting plate comprises sintered carbide material.

8. A sewing machine according to claim 1, wherein said cutting edges each extend in a direction perpendicular to said axis of symmetry of said cutting plate.

9. A sewing machine according to claim 2, wherein said cutting edges each extend in a direction perpendicular to said axis of symmetry of said cutting plate.

10. A sewing machine according to claim 4, wherein said cutting edges each extend in a direction perpendicular to said axis of symmetry of said cutting plate.

11. A sewing machine according to claim 10, wherein said cutting edges each extend in a direction perpendicular to said polygonal shaft.

* * * * *